United States Patent [19]

Mineck

[11] 4,309,367

[45] Jan. 5, 1982

[54] CARBURETOR EMPLOYING FUEL AIR MIXTURE MEANS OPERATIVE PRIOR TO CARBURETION

[75] Inventor: Fred Mineck, Phoenix, Ariz.

[73] Assignee: Warren F. B. Lindsley, Phoenix, Ariz. ; a part interest

[21] Appl. No.: 230,891

[22] Filed: Feb. 2, 1981

[51] Int. Cl.[3] ..... F02M 19/06

[52] U.S. Cl. ..... 261/121 A

[58] Field of Search ..... 261/121 A

[56] References Cited

U.S. PATENT DOCUMENTS 1,731,123 10/1929 Brut ..... 261/121 A
1,929,266 10/1933 Viel ..... 261/121 A
1,970,713 8/1934 Stafford et al. ..... 261/121 A
2,103,629 12/1937 Moore ..... 261/121 A
3,485,482 12/1969 Fuchs ..... 261/121 A

*Primary Examiner*—Tim R. Miles
*Attorney, Agent, or Firm*—Warren F. B. Lindsley

[57] ABSTRACT

An improved carburetor for an internal combustion engine which eliminates the known power valve and comprises a hollow male member for extending into an opening in the carburetor housing provided for the power valve and a female member threadedly engaging the male member and providing a passageway for air to pass from within the carburetor above its liquid fuel content to the hollow interior of the male member. Parts are provided in the interior of the male member for transmitting air to venturi parts of the carburetor for pre-mixing the fuel.

6 Claims, 7 Drawing Figures

FIG. 5
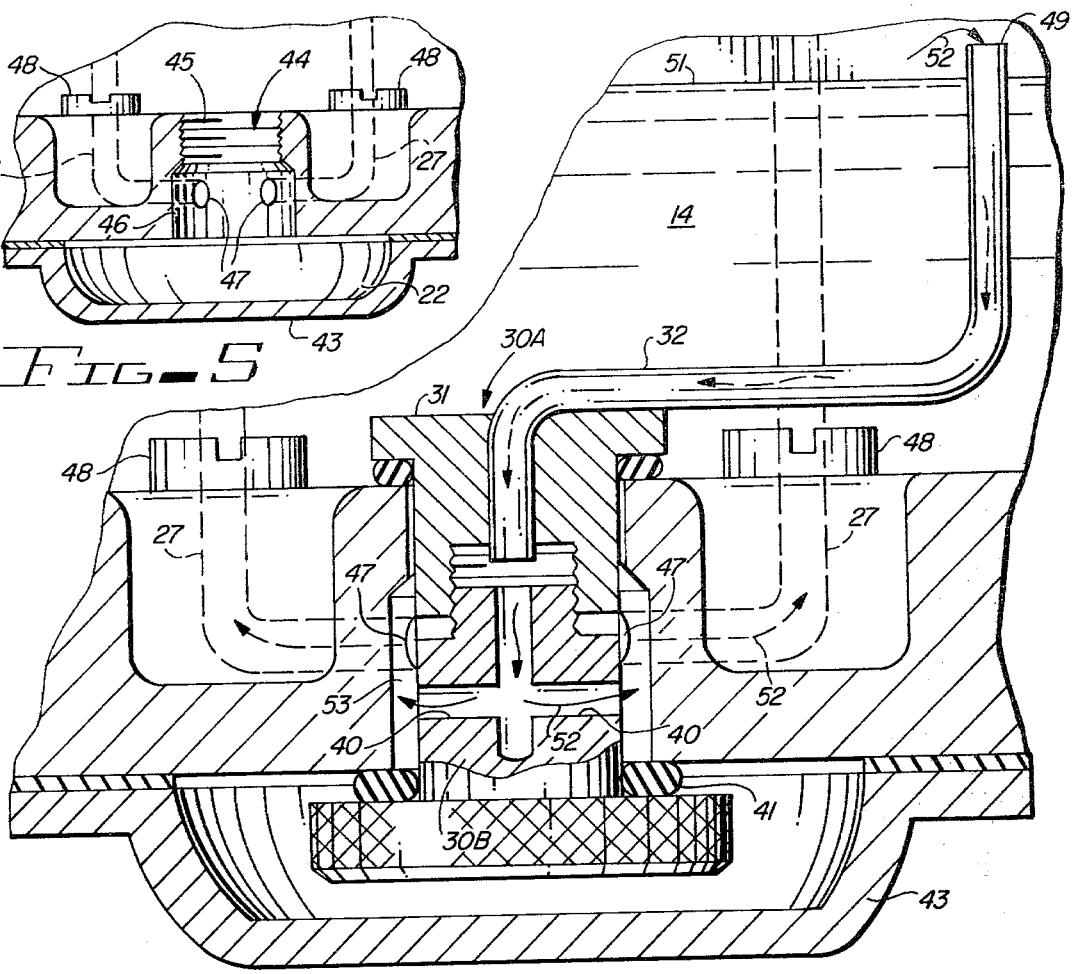
FIG. 6
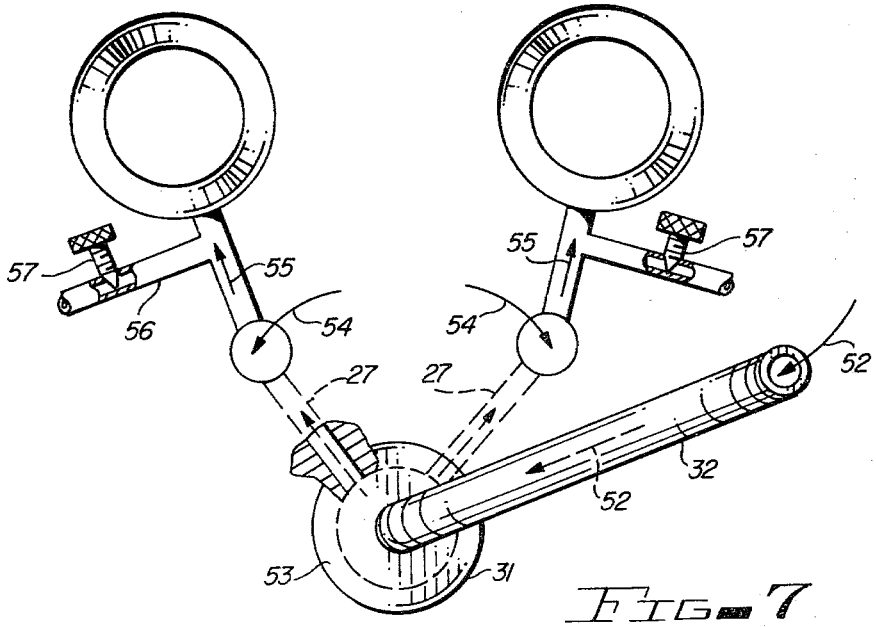
FIG. 7

CARBURETOR EMPLOYING FUEL AIR MIXTURE MEANS OPERATIVE PRIOR TO CARBURETION

BACKGROUND OF THE INVENTION

One of the most important parts of an internal combustion engine is its carburetor. Unless the carburetor performs well the engine will not start reliably, will not run smoothly and deliver adequate power and good gasoline mileage, and will produce excessive atmospheric pollutants.

Because the proper operation of the carburetion system is so essential to total engine performance, much attention has been given in the past to carburetor design and over the years the carburetor has become a complex device.

The complexity of the modern carburetor is apparent when it is recognized that the typical carburetor system employs six separate systems i.e. a float system for controlling the level of fuel in the bowl; a low speed or idling system to provide an adequate fuel supply when air intake is low; a high speed or cruising system utilizing the venturi; an accelerating pump system to overcome fuel inertia during a sudden increase in power demand; a power system to provide adequate fuel under conditions of reduced vacuum resulting from the opening of the throttle; and a choke system for increasing the fuel-to-air ratio under starting or low temperature conditions.

In addition, there are anti-percolation vents, hot idle compensators, anti-dieseling solenoids and deceleration controls in most modern carburetors.

This multitude of special systems and features requires careful adjustment and maintenance and the many small ducts and valves are vulnerable to blockage and wear by dust and dirt finding their way through the air filter.

Furthermore, until recently there has been a greater emphasis on certain aspects of performance, such as starting, acceleration and power developed with insufficient emphasis given to gasoline mileage and atmospheric polluting conditions.

Thus, a need exists for a new carburetor design which will produce a better balance in total performance while utilizing a simpler design.

DESCRIPTION OF THE PRIOR ART

The automobile manufacturers have used well known two barrel carburetors over the years which employ a spring biased diaphragm power valve for use when accelerating. This power valve has a history of leakage and failure costing car owners a great deal of expense in wasted fuel.

All gasoline is supplied to the prior art carburetors for air mixing purposes by a rush of air through the venturis created a suction action which draws gasoline from a low level in a float bowl of the carburetor to the higher level of the venturis in the carburetor system. The venturis mix the gasoline with the air rushing therethrough.

The power valve used in most carburetors is simply a valve that lets more gasoline into the supply line to the venturis at a low vacuum when the throttle valve is opened for more acceleration of the vehicle. The same function occurs in carburetors disclosed employing the claimed fuel air mixing means except that fuel laden air is admitted from inside the carburetor bowl to a point ahead of the fuel intake jets to the venturi. This action mixes a predetermined amount of air with the gasoline to increase the velocity of the moving fluid and decreases the inertia movement of the now mixed gasoline and air over that of gasoline, per se, as occurs in the present day carburetors. This pre-fuel and air mixture also helps with better mixing of the normal fuel and air flow through the venturi and idle jets during low speed city driving. The elimination and the substitution therefor with the claimed device in all known two barrel carburetors will save considerable fuel and at the same time eliminate a moving part in the carburetor system.

SUMMARY OF THE INVENTION

In accordance with the invention claimed, an improvement is made to a known carburetor such as one used by the Ford Motor Company which increases its effectiveness by pre-mixing the fuel with air prior to the fuel entering the carburetor and by eliminating its power valve.

It is, therefore, one object of this invention to provide improved carburetion of the fuel used in an internal combustion engine.

Another object of this invention is to provide improved fuel mixture in a carburetor by replacing its power valve with an air-fuel pre-mixing plug.

A further object of this invention is to provide an improvement in a known Ford carburetor which premixes the fuel entering the carburetor by a plug replacing its known power valve without involving the addition of any moving parts.

A still further object of this invention is to provide an improved fuel entrance plug for a carburetor which effectively pre-mixes the fuel before it is normally carburized by the carburetor yielding more finely divided fuel droplets than heretofore possible resulting in optimum performance at all engine speeds.

A still further object of this invention is to provide an improved carburetor in which the inertia movement of the fuel is decreased over that of present day carburetors.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which:

FIG. 5 is a partial cross-sectional view of the carburetor bowl seat shown in FIG. 1 without the power valve to show the air outlet holes in its bore;

FIG. 6 is an enlarged partially broken away view of the new replacement plug for the power valve of FIG. 1 in place in the carburetor; and FIG. 7 is a diagrammatic view of the pre-air and fuel flow through the pre-mixing plug to the venturis of the carburetor and embodying the invention.

DESCRIPTION OF THE PREFERRED EMBODIMENT

Figure 1:
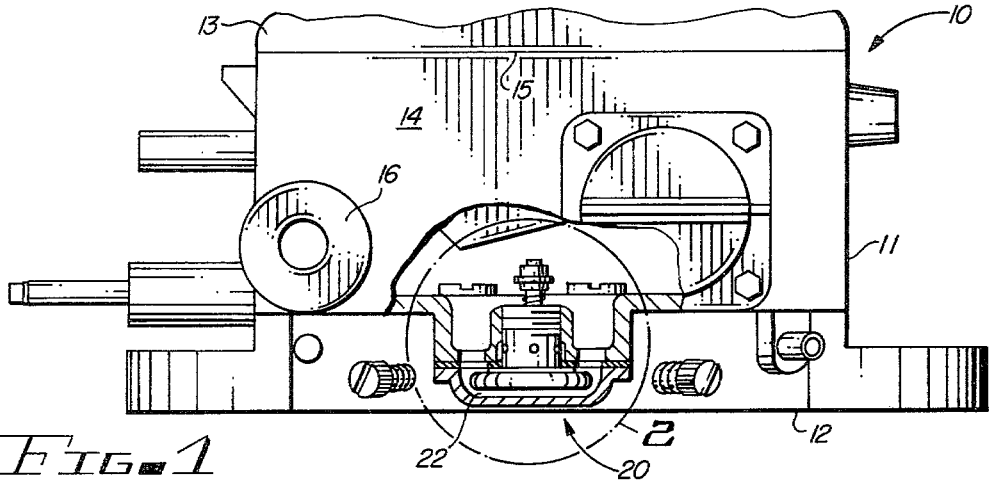
FIG. 1 (PRIOR ART)
FIG. 1 is a perspective view partially broken away showing a known Ford Motor Company carburetor.
Figure 2:
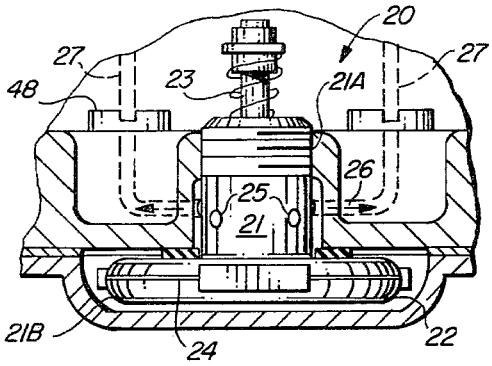
FIG. 2 (PRIOR ART)
FIG 2 is an enlarged view of the circled area of FIG. 1.

Referring more particularly to the drawings by characters of reference, FIGS. 1 and 2 disclose a known carburetor 10 used for many years by the Ford Motor Company. This carburetor comprising a carburetor housing 11 is rigidly secured between a conventional throttle plate 12 at one end and an open centered disc shaped air filter housing 13 at its other end. The air filter housing contains a circular air filter (not shown), well known in the art.

The carburetor housing comprising a hollow rectangular configuration defines a fuel reservoir 14 having an air intake opening 15 formed in its top and a fuel inlet 16.

Reservoir 14 has the usual pivotally mounted float 17 (shown in FIG. 4) mounted therein which is mechanically connected to a known fuel metering valve 18 associated with fuel inlet 16.

Fuel from reservoir 14 is drawn through the valve stem of a metering valve assembly 20 shown in FIGS. 1 and 2 commonly called a power valve. It is this assembly 20 which is replaced by the air fuel pre-mixing plug of the present invention.

Valve assembly 20 comprising a stationary outer shell 21 is mounted in carburetor housing 11 with the upper hollow vertically positioned cylindrical portion 21A of shell 21 threadedly mounted in a flange attached inside of the carburetor housing. The lower portion 21B of shell 21 is in the form of a hollow disc or torus, positioned horizontally and opening upwardly into the interior of portion 21A. The underside of portion 21B opens into an enclosed chamber 22 which is in communication with the intake manifold of the engine.

Mounted inside shell 21 of valve assembly 20 is a spring-loaded shaft 23, the lower end of which is secured to a flexible diaphram 24 that is mounted inside shell portion 21B. Diaphram 24 seals off chamber 22, which is at intake manifold pressure, from reservoir 14 which holds liquid fuel. The vacuum produced in the intake manifold and present also in chamber 22 pulls shaft 23 downwardly against its spring force to close valve assembly 20 thereby inhibiting its function of delivering supplementary fuel to the carburetor jets. Under conditions of reduced vacuum in the intake manifold, as during acceleration, shaft 23 moves upwardly, opening ports 25 in upper shell portion 21A. Ports 25 then pass fuel 26, the fuel flowing through passages 27 to the carburetor jets.

While the valve assembly 20, commonly known as the power valve, thus delivers supplementary fuel as needed under conditions of increased power, the power valve has in its application been fraught with frequent failures and has consequently been the cause of poor engine performance such as high pollution, poor gas mileage, etc. The power valve failures typically include leakage past threads around the outer periphery of upper shell portion 21A, clogging of the valve by dirt that prevents the valve from closing or a cracked diaphram which passes gas directly into the intake manifold in large quantities.

Figure 3:
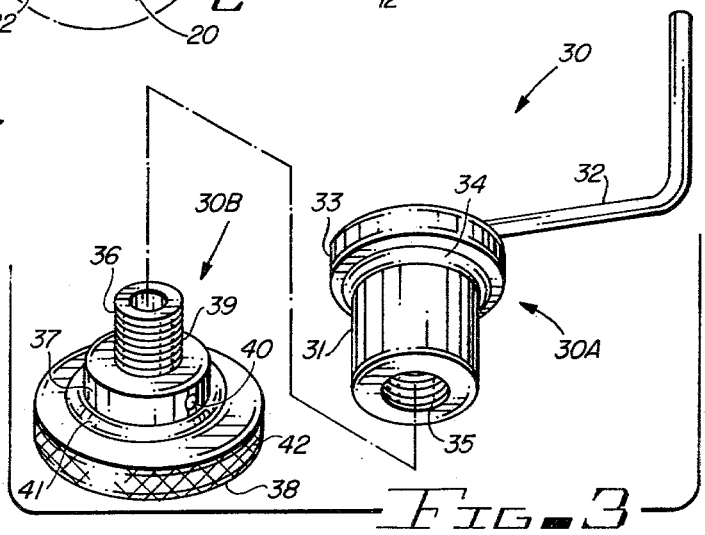
FIG. 3 is an exploded perspective view of the replacement plug for the power valve of the prior art carburetor shown in FIG. 1.

In accordance with the invention claimed air fuel pre-mixing plug 30 is disclosed in FIG. 3 and comprises an upper female member 30A and a lower male member 30B.

Upper member 30A comprises an inverted, thick-walled cup 31 and a bent hollow tube 32. Tube 32 enters cup 31 through its closed upper end thereby connecting the interior of tube 32 with the hollow interior of cup 31. Cup 31 has an annular enlargement 33 around its circumferance at its closed end which serves as a shoulder for backing up an O-ring seal 34. The interior surface 35 of cup 31 is threaded as illustrated in FIG. 3.

The lower member 30B comprises a cylindrical configuration formed in three sections including a hollow top section 36, a center section 37 and a lower section 38. The top section 36 has a relatively small outside diameter with its outer cylindrical surface 39 being threadedly formed to mate with the threaded interior surface 35 of member 30A. Section 37 has a diameter somewhat greater than that of section 36 with its outer surface conically tapered so that its diameter at its base is slightly greater than its diameter at its top. Two diagonally positioned holes 40, only one of which is shown in FIG. 3, extend into the conically tapered surface 39 of section 37 from opposite sides thereof opening into the hollow interior of section 36. Section 38 has a diameter somewhat larger than that of section 37 so that its annular protrusion beyond the circumference of section 37 again forms a shoulder which serves to back-up a second O-ring seal 41. The cylindrical outer surface 42 of section 38 is knurled for gripping by the fingers of a mechanic during installation.

FIG. 5 is a cross-sectional view of the opening that normally holds the power valve assembly 20. In the view of FIG. 5, assembly 20 has been removed with the lower cover 43 normally mounted over the protruding lower portion 21B of shell 21 forming chamber 22 which is in communication with the intake manifold. The cylindrical bore 44 which serves as the opening in which valve assembly 20 is mounted has a threaded upper portion 45 and a relatively enlarged lower portion 46. The threaded upper portion would receive the threaded end of shell 21 if the valve assembly 20 was installed. Two small holes 47 in the walls of the enlarged lower portion 46 of bore 44 open into passages 27 which lead to main fuel jets 48 and on from there to the venturi ports of carburetor 10.

The installation of plug 30 in carburetor 10 is accomplished as follows: With cover 43 and valve assembly 20 removed, cup 31 of member 31A is first installed from below, threading section 36 into the threaded interior surface 35 of cup 31. As member 30B is threaded into cup 31, the O-ring seals 34 and 41 form air and liquid seals between the mating surfaces. Cover 43 is then replaced over lower member 30B.

Figure 4:
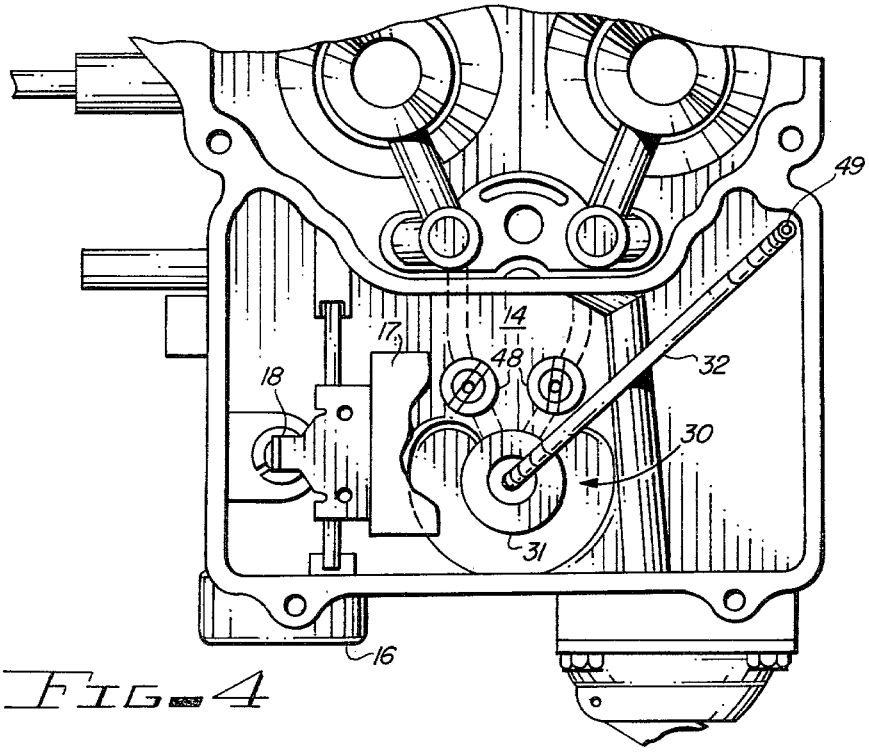
FIG. 4 is a top view of the carburetor shown in FIG. 1 with the replacement plug of FIG. 3 embodied therein.

FIGS. 4 and 6 show plug 30 installed as just described in carburetor 10. The bent tube 32 is seen to leave cup 31 vertically upward, but immediately bending at a right angle, extending horizontally to one corner of reservoir 14, then bending again at a right angle and extending upwardly, its termination 49 opening above the surface 51 of the fuel held by reservoir 14.

As shown in FIG. 6, fuel laden air 52 enters the open end of tube 32, travels downward through tube 32, enters the interior of cup 31, passes through the hollow interior of member 30B, then passes out through the holes 40 into a cylindrical chamber 53 formed by clearance between section 37 of member 30B and the enlarged lower portion 46 of bore 44. From chamber 53 the air 52 passes through holes 47 into passages 27 which lead to the main fuel jets 48. At jets 48 the fuel laden air 52 mixes with fuel delivered by jets 48 from reservoir 14, and the resulting fuel air mixture is carried on to the venturi ports.

A diagrammatic presentation of the routes taken by the air and the fuel air mixture is shown in FIG. 7 wherein air 52 entering the open end of tube 32, passes downwardly through tube 32 to cup 31, into chamber 53, through passages 27 to main jets 48. At jets 48 the air mixes with fuel 54. The resulting fuel air mixture 55 passes on to passages 56 that lead to the idler jets 57 and on to the venturi tubes 58 of carburetor 10.

The replacement of the power valve with the air fuel pre-mixing plug 30 of the invention has a number of advantages.

The first advantage is that the frequent and troublesome failures associated with the power valve are eliminated. The loss of the power valve function which is only marginally effective when operative is considered to be more than offset by the elimination of the very poor performance achieved when the power valve is defective.

A second advantage is that the pre-mixing of air and fuel as afforded by means of plug 30 produces an overall improvement in carburetion and a more thoroughly mixed air fuel vapor as delivered to the manifold from the carburetor venturis.

A further advantage is an increase in fuel velocity that is achieved as a result of the air injected into the fuel as it enters the main jets 48. The increased velocity of the fuel air mixture 55 in its passage from jets 48 to venturis 58 is believed to contribute to improved carburetion achieved in the venturi portion of the carburetor thus helping acceleration of the associated vehicle. Fuel mixed with fuel laden air decreases the inertia movement of this mixture over that of the gasoline flow through the prior art carburetors.

A still further advantage is that the pre-mixing plug 30 has no moving parts and is thus reliable on a long-term basis.

Yet another advantage is that the O-ring seals are long-life and virtually permanent seals.

Finally, the pre-mixing plug is mechanically interchangeable with existing power valve assemblies, and its ease of installation facilitates the replacement of a defective valve.

A first embodiment of the invention as just described was installed and tested in a 1976 Ford LTD having a 351 cubic inch engine at 55 MPH, with the air conditioning operating in an outside temperature in excess of 100 degrees F., humidity at 55% and with two passengers in the car. The gas mileage achieved in driving along substantially flat terraine between Phoenix and Wickenburg, Ariz. was 28 miles per gallon on regular gas. The odometer of the car registered 64,000 miles and the car weighed 6300 pounds. The car had good acceleration, ran smoothly, and the spark plugs showed a light brown color which indicated that the engine was not running too lean.

An improvement in carburetion, gas mileage, engine performance and reliability are thus achieved through the provision of the air fuel pre-mixing plug of the invention, and although but a single embodiment of the invention has been illustrated and described, it will be apparent to those skilled in the art that various changes and modifications may be made therein without departing from the spirit of the invention or from the scope of the appended claims.

What is claimed is:

1. An air fuel pre-mixing plug for mounting in a carburetor in lieu of its associated power valve comprising:

a pair of threadedly attachable parts, one of said parts comprising a hollow male member for extending into an opening in the carburetor housing provided for the power valve, the other of said parts comprising a female member threadedly engaging with said male member from within the carburetor housing and providing a passageway for air to pass from within the carburetor above its liquid fuel content to the hollow interior of said male member, said parts when engaged sealing said opening, and port means extending from the interior of said male member outwardly thereof for transmitting said air to venturi ports of the carburetor.

2. The air fuel pre-mixing plug set forth in claim 1 wherein:

said female member comprises a tube extending outwardly thereof forming said passageway.

3. The air fuel pre-mixing plug set forth in claim 1 wherein:

said port means comprises a pair of spacedly positioned holes around the periphery of said male member.

4. The air fuel pre-mixing plug set forth in claim 1 wherein:

said port means comprises a pair of diagonally positioned holes arranged around the periphery of said male member.

5. The air fuel pre-mixing plug set forth in claim 1 wherein:

each of said pair of threadedly attachable parts comprise cylindrical configurations.

6. The air fuel pre-mixing plug set forth in claim 1 wherein:

said male member comprises a cylindrical configuration formed in three sections, one of said sections comprising a hollow tubular configuration threaded along its outer surface for engaging with said female member, a second one of said sections comprising a tapered configuration connected at its apex to said one of said sections and at its base to a third section, said port means being provided in said second one of said sections, and said third section comprising a disc shaped configuration having a diameter larger than said base for providing a seat for an O-ring around the junction of said base with said third section.

* * * * *